US005718625A

United States Patent [19]

Bointon

[11] Patent Number: 5,718,625

[45] Date of Patent: Feb. 17, 1998

[54] COIN STORE

[75] Inventor: Richard Guy Bointon, Plymouth, Great Britain

[73] Assignee: Mars Incorporated, McLean, Va.

[21] Appl. No.: 553,486

[22] PCT Filed: May 19, 1994

[86] PCT No.: PCT/GB94/01080

§ 371 Date: Feb. 7, 1996

§ 102(e) Date: Feb. 7, 1996

[87] PCT Pub. No.: WO94/28520

PCT Pub. Date: Dec. 8, 1994

[30] Foreign Application Priority Data

May 21, 1993 [GB] United Kingdom ..... 9310636

[51] Int. Cl.[6] ..... G07D 9/04

[52] U.S. Cl. ..... 453/17; 414/796.8

[58] Field of Search ..... 453/17, 20, 21, 453/40, 41; 221/10, 13, 14, 232; 414/796.7, 796.8

[56] References Cited

U.S. PATENT DOCUMENTS

| | | | |
|---|---|---|---|
| 4,403,900 | 9/1983 | Thomas | 414/137 |
| 4,687,089 | 8/1987 | Wuethrich | 194/230 |
| 5,017,085 | 5/1991 | Ishikawa | 414/796.8 X |
| 5,022,890 | 6/1991 | Rapp | 453/56 |
| 5,067,928 | 11/1991 | Harris | 453/17 |

FOREIGN PATENT DOCUMENTS

| | | | |
|---|---|---|---|
| 2423688 | 11/1975 | Germany . | |
| 3227438 | 1/1984 | Germany . | |
| 4041078 | 6/1992 | Germany | 453/17 |
| 1179424 | 1/1970 | United Kingdom . | |
| 1549580 | 8/1979 | United Kingdom . | |
| 2112195 | 7/1983 | United Kingdom . | |
| WO 90/09646 | 8/1990 | WIPO . | |
| WO 91/07734 | 5/1991 | WIPO . | |

*Primary Examiner*—F. J. Bartuska
*Attorney, Agent, or Firm*—Fish & Richardson P.C.

[57] ABSTRACT

A last-in-first-out coin store comprises a tubular housing (21) in which a coin stack support (22) is driven upwardly or downwardly by an endless belt (28) driven from a motor (23). A coin dispensing mechanism comprises a bar (37) positioned above the tubular housing (21) between a pair of beams (A, B) of light mutually normal, axially displaced along the coin store axis by half the width of a coin, and crossing the center of the coin stack. A control circuit (80) raises and lowers the coin support (22) automatically so as to maintain the uppermost coin at a position where one, but not both, of the light beams are broken so that a coin is ready to be dispensed by the bar (37). A count is kept of the number of coins by a counter circuit (90) responsive to an encoder on the drive belt (28). Useful in gaming machines or change giving coin freed machines.

33 Claims, 6 Drawing Sheets

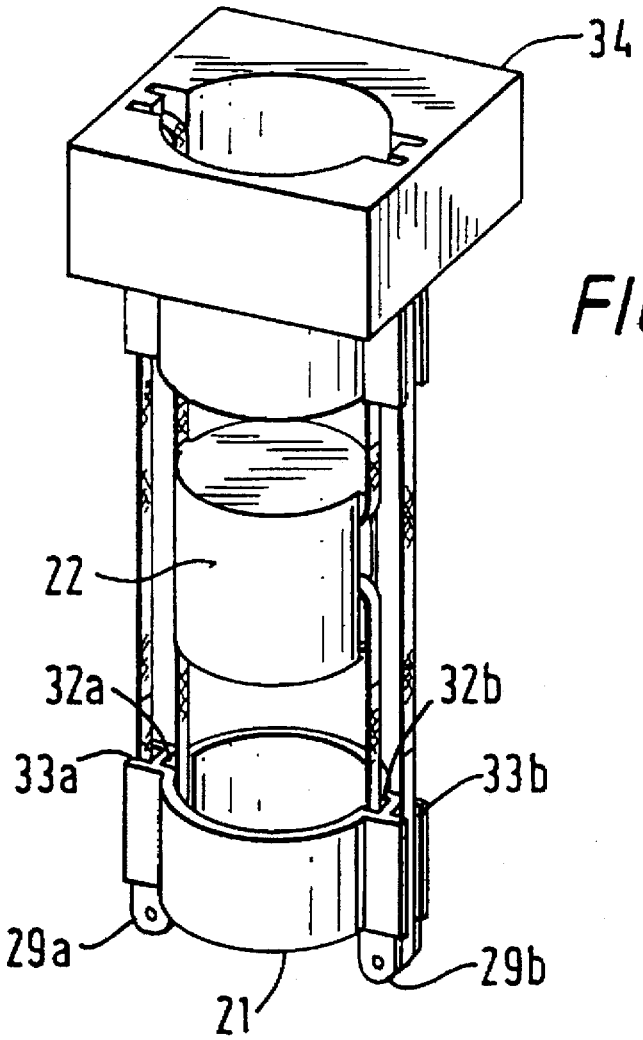
FIG. 5
FIG. 6
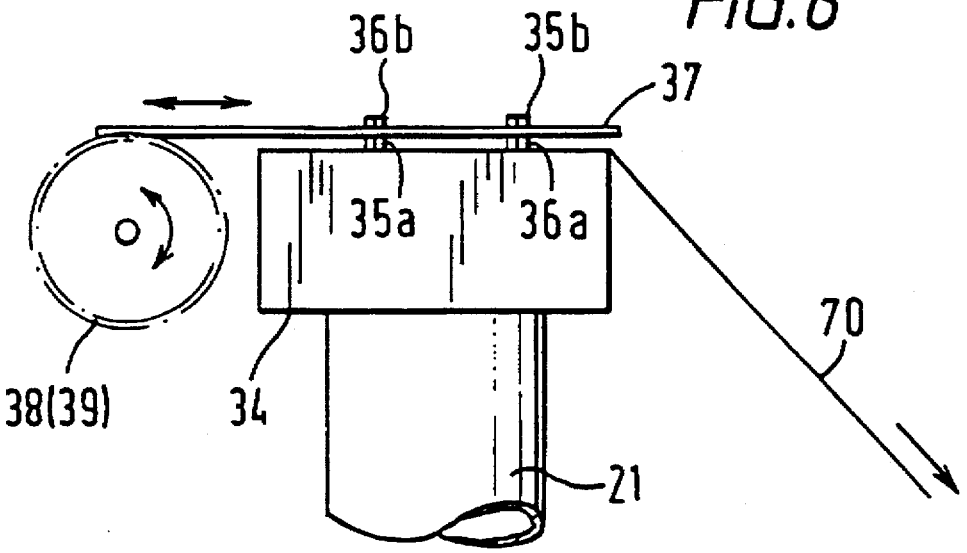

COIN STORE

FIELD OF THE INVENTION

This invention relates to a coin store. More particularly, this invention relates to a coin store for use in coin operated machinery, of the type in which the last coin to enter the snore is the first to be dispensed therefrom.

BACKGROUND OF THE INVENTION

In some types of coin operated machinery (for example, gaming machines) it is desired not only to accept coins but also to dispense coins. In a well known type of coin mechanism for gaming machines, coins are received at a coin entry slot; passed through a coin acceptor mechanism to validate the coins; and, if accepted, are deposited into the top of a change tube storing a stack of coins. When it is desired to dispense coins (for example, because of a win) the lowermost coin is dispensed from the bottom of the tube into a coin exit in a pay-out tray, the stack of coins drops, and the next coin (if required) is dispensed.

A first problem with this arrangement is that the height of the tube, and hence the number of coins which the tube can store, is limited by the acceptable distance between the coin entry slot and the pay-out tray; for ergonomic reasons, the pay-out tray cannot be placed too low or the coin entry slot too high. A second problem is that, on dispensing a coin the force required to dispense a coin from the bottom of the tube can be relatively high, due to the weight of the coins above i: in the tube. Finally, it is possible to defraud the gaming machine by inserting counterfeit coins into the entry slot so that they are deposited into the top of the change tube, and receiving genuine coins in return from the bottom of the change tube.

In WO-A-91/07734 and DE-A-3937471, a coin storage device is proposed in which coins are deposited into the top of the stack which is lowered to receive the coins. To pay out coins, the stack is raised and the top most coin is dispensed. A somewhat similar arrangement is disclosed in U.S. Pat. No. 4,687,089, in which the stack is in an inclined orientation.

In WO-A-91/07734, a reversible motor is arranged to raise or lower the stack of coins in the coin store, in response to control signals from a microprocessor. Sensors are provided in the coin inlet channel and in the coin dispensing channel, leading respectively to and from the store, so that when a coin approaches the store the microprocessor can cause the motor to drive the stack of coins downward to receive the new coin. When it is desired to dispense a coin, the microprocessor causes the motor to raise the stack of coins. In a first arrangement, the motor is also geared to a coin dispensing device, which is therefore driven at the same time to push the uppermost coin off the stack towards the coin exit. In a second arrangement, a microswitch sensor is provided above the coin slack, so that when the coin stack is driven upwards the microswitch is actuated, causing the uppermost coin to be dispensed.

In U.S. Pat. No. 4,687,089, a control device controls a reversible motor to raise or lower the coin stack in the coin store. A control device operates in a first mode when coins are being stacked within the coin store, in which mode the control device responds to an inductive sensor at the top of the stack to lower the stack until there is no signal from the sensor (i.e. when the uppermost coin lies below the sensor). The control device operates in a second mode when it is desired to dispense coins, in which mode the motor is operated to raise a coin stack until the uppermost coin rises above the top of the coin store; since the coin stack is inclined, the coin falls through an exit channel towards the coin exit. A sensor disposed in the exit channel counts the coins, and, when the desired number of coins have passed the sensor, the control device halts upward movement of the coin stack.

Both of these arrangements are potentially inaccurate; in WO-A-91/07734, since the coin stack is being raised whilst the dispensing mechanism operates, variations in coin speed or loss of synchronism between the coin stack motor and the dispenser could lead to inadequate dispensing operation whereas in U.S. Pat. No. 4,687,089, the number of coins dispensed may be inaccurate where, for example, several coins are stuck together or follow closely after one another, so that the sensor in the coin exit channel responds too late to stop the motor.

Reference is made to WO-A-90/09646 which describes a coin payout device consisting of a horizontal coin storage tube which receives coins from a coin feed/payout device. The resulting column of coins in the tube pushes against a spring loaded plunger which operates an optical shaft encoder to provide a digital signal indicative of the number of coins in the column. The coin feed/payout device consists of a rotary drive member driven by an electric motor, which upon rotation in a first direction captures a coin and inserts it into the tube, and upon rotation in the opposite direction, removes a coin from the tube for payout.

Reference is also made to DE-A-2423688 which describes a coin dispenser having tubular coin stores in which the dispensing opening is arranged at their upper end. A pressure spring, having a spring constant equal to the quotient of the coin weight and the coin thickness, is used to hold the stack. The spring excursion is equal to the product of the desired number of coins to be stored and their thickness. In one embodiment, the coin stores are removable when a security device has been actuated to close off the contents of the coin stores. In another embodiment, a motor drive is used to lift the coins when a coin is to be dispensed, and to lower the coins to make room for accepting a new coin.

SUMMARY OF THE INVENTION

Accordingly, in one aspect of the invention, we provide a coin store comprising means for forming a stack of coins, a common coin entry and exit point at one end of the coin stack, means for moving the stack of coins away from and towards that end of the coin stack, and means for dispensing a coin from that end, wherein the stack moving means comprises a drive motor operatively connected to the stack forming means, and the store further comprises position control means for controlling the drive motor to position the stack such that the endmost coin in the stack is placed in a position from which it can be dispensed by the dispensing means, characterised in that the control means is operable to position the endmost coin ready for dispensing as a separate and prior operation to the operation of dispensing a coin, and to maintain the stack of coins at a substantially constant level with the endmost coin in a position ready for dispensing, and further characterised in that during a dispensing operation, the dispensing means is actuated prior to any actuation of the stack moving means.

Thus, in this aspect, the endmost coin is positioned ready for dispensing as a separate and prior operation to the operation of dispensing a coin. Because the position of the endmost coin is established prior to dispensing, the likelihood of jamming, or over or under payment is reduced.

Where multiple coins are to be paid out, the position of each can be clearly established prior to dispensing.

In another aspect, we provide a coin stack positioning system which comprises first and second sensors for sensing first and second positions separated along the length of the coin stack by a separation less than the width of the coin, and positioning means arranged to be responsive to the sensor outputs, to position a coin to lie with an outer portion thereof between the first and second sensors. This provides an accurate way of positioning the top of a coin in a position ready for dispensing, which is useful in the first aspect of the invention but may be used in other applications.

A preferred feature of the invention as defined in the above aspects is the provision of means responsive to the length of the coin stack for maintaining a count of the number of coins in the stack based on the detected length. For example, the length of the coin stack may be detected by detecting movements of the stack moving means (preferably by providing an indexing system, for example an optical indexing system) to track upwards movements of the coin stack which correspond to dispensing a coin or downwards movements of the coin stack which correspond to accepting a coin. Thus, it is not necessary to provide separate sensors for detecting the receipt or dispensing of a coin.

In a further aspect, the invention provides a coin handling apparatus for accepting and dispensing coins, which comprises means for accepting at least one coin carrying tube arranged both to accept and to dispense coins from the same end, the accepting means being arranged to allow easy detachment and replacement of the coin carrying tube.

In a related aspect, the invention also provides a coin carrying tube adapted for use with the above coin handling apparatus.

In this document, the term "coin" is intended to include coin-like tokens, whether or not they are official or convertible currency, and (where appropriate) counterfeit coins or "slugs"

In this document, the terms "light", "optical" and so on are intended to include forms of radiation which substantially obey the laws of optics, whether or not they lie within the visible spectrum.

The invention will now be illustrated, by way of example only, with reference to the accompanying drawings.

BRIEF DESCRIPTION OF THE DRAWINGS

FIG. 5 is a semi-sectional isometric view from the same view point as FIG. 4 showing the same structure as FIG. 3;

FIG. 6 is a right hand end elevation of the embodiment of FIGS. 3–5, and also showing the dispensing mechanism of the coin store thereof;

DETAILED DESCRIPTION

Figure 1:
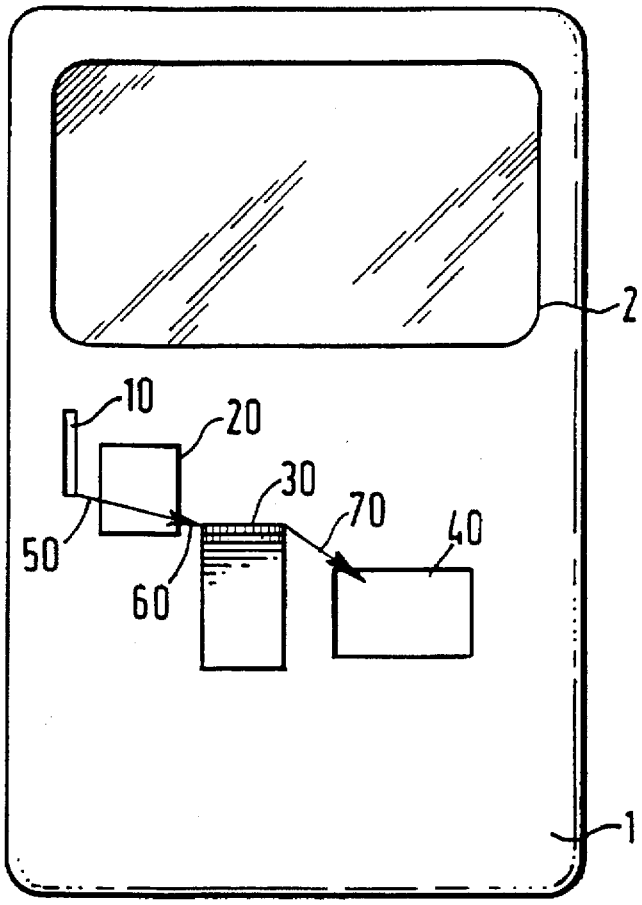
FIG. 1 shows schematically the arrangement of a coin operated machine incorporating an embodiment of the invention.

Referring to FIG. 1, a coin-operated machine comprises a housing 1, a coin entry slot 10, a coin acceptor mechanism 20, a coin store 30, and a coin outlet 40. A first coin entry channel 50 interconnects the coin entry slot 10 and coin acceptor 20; a second coin entry channel 60 interconnects the coin acceptor 20 and the coin store 30, and a coin exit channel 70 interconnects the coin store 30 and the coin outlet 40.

The coin entry slot 10, coin acceptor 20, housing 1, coin outlet 40 and coin control 50, 60, 70 are in themselves of generally conventional design. For example, the acceptor may be as described in our earlier application GB-A-2094008 or GB-A-2093620.

Also present, indicated generally by 2, is conventional coin-operated machinery (for example, for playing a game) which is actuated in response to acceptance of a coin by the coin acceptor 20.

Although only a single coin store 30 is shown in FIG. 1, in embodiments which are intended to receive multiple coin denominations, a plurality of such coin stores 20*a*, 20*b* . . . etc are provided, connected via respective coin entry channels 60*a*, 60*b* . . . to respective outlets of the coin acceptor 20 and via respective outlet channels 70*a*, 70*b* . . . to the coin outlet 40.

Figure 2:
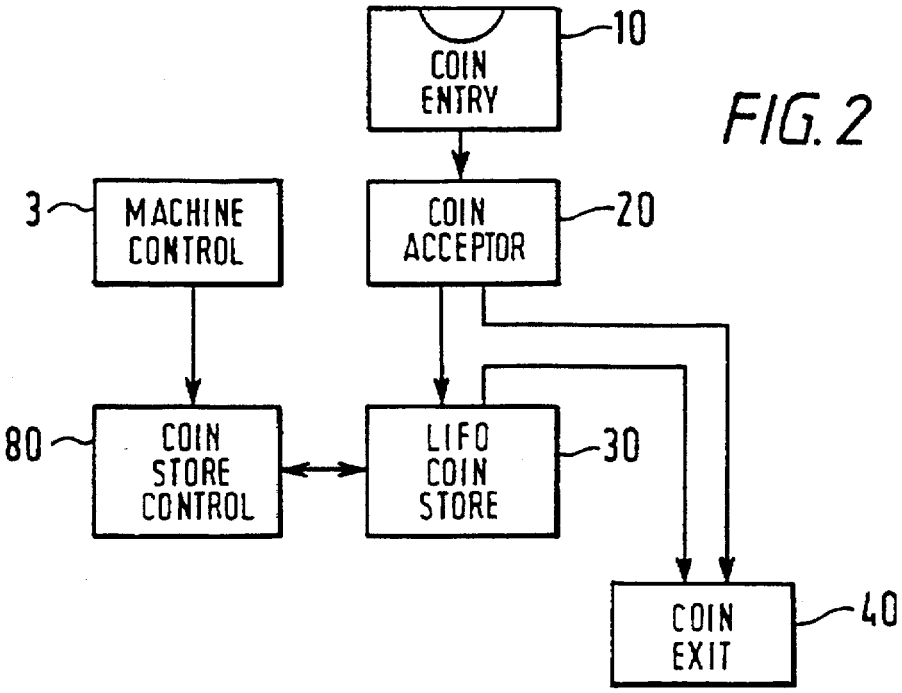
FIG. 2 shows schematically the interconnection of the components of FIG. 1.

In operation, as shown in FIG. 2, a coin is inserted into the coin entry slot 10 and rolls down the coin channel 50 to the acceptor 20. If the coin is acceptable, the acceptor 20 passes it to the inlet channel 60, through which it rolls into the coin store 30. The coin is received onto the top of a stack of coins in the store, the top of which is kept at a constant level, as detailed below. If the coin is rejected, the acceptor 20 passes it through a reject coin channel (omitted from FIG. 1 for clarity) to the coin outlet 40. When it is necessary to pay out coins, for example where a user has won a game or where change is required, the control unit 3 of the coin operated machinery 2 supplies a command signal to a control circuit 80 of the coin store 30 to supply the uppermost coin to the coin exit channel 70, down which it rolls to the coin outlet 40 which comprises a payout tray from which it may be retrieved by the user.

Figure 3:
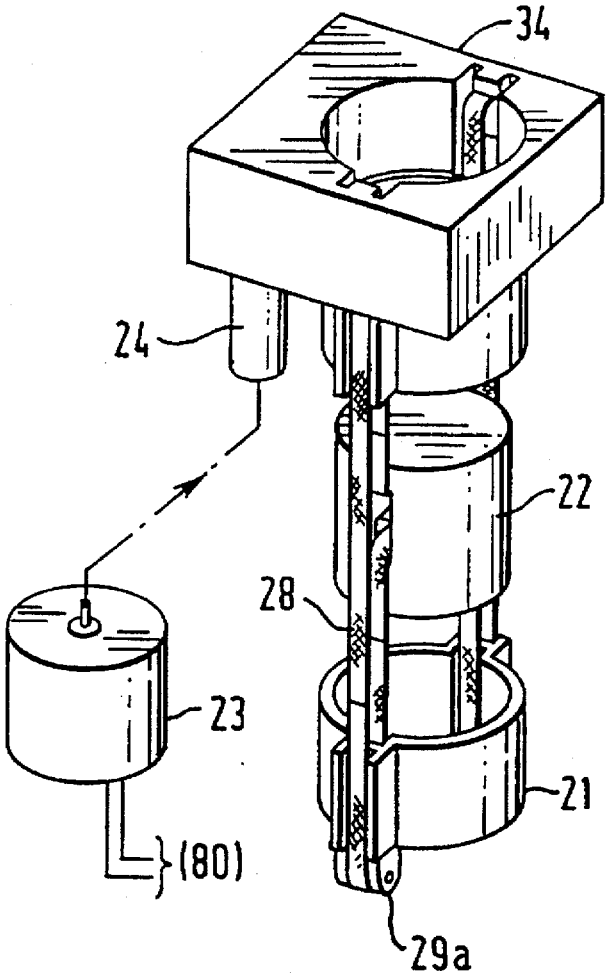
FIG. 3 is a semi-sectional isometric view of a coin store forming part of the embodiments of FIGS. 1 and 2 from the front and left.

Referring to FIG. 3, the coin store 30 will now be described in greater detail.

The coin store comprises a tubular housing 21, which in this embodiment is of a translucent plastics material to allow inspection of the length of the coin slack. The housing 21 in this embodiment is intended to be vertically oriented, to receive a vertical stack of coins lying flat (i.e. normal to the axis of the housing 21), and is accordingly of generally circular cross-section.

Figure 4:
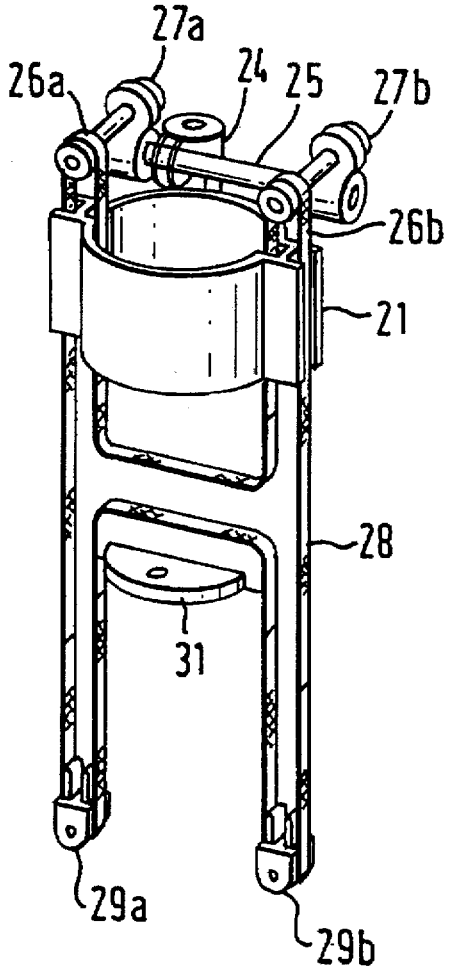
FIG. 4 is a semi-sectional isometric view from the front and right of the coin store of FIG. 3, with an upper housing and a coin support component removed.

The tubular housing 21 is a continuous tube, but for clarity portions of the tube are omitted from FIGS. 3, 4 and 5 so as to allow other features to be seen.

Mounted to slide within the tubular housing 21 is a coin stack support platform 22 comprising a cylindrical block having a coin-receiving surface in the part of the housing 21 which, in use, is the upper part. Coins are received onto the platform 22 to form a stack, which is moved within the housing 21 by moving the platform 22.

Connected to move the platform 22 is a stack drive system (shown in greater detail in FIG. 4) comprising a motor 23 mounted fixedly to the housing 21 and connected through an input drive shaft 24 via a worm gear to a horizontal axle 25 which is connected at each end to a respective drive pulley 26*a*, 26*b*, via oppositely acting worm and wheel gear pairs 27*a*, 27*b*.

An endless drive belt 28 runs over the drive pulleys 26*a*, 26*b* to form a bight therebetween which passes through the upper part (in use) of the platform 22. On the other side of the drive pulleys 26*a*, 26*b* The belt 28 passes vertically along the length of the tubular housing 21 to pass over a pair of idler pulleys 29*a*, 29*b* aligned with the drive pulleys 26*a*, 26*b*. Between the idler pulleys 29*a*, 29*b* the belt 28 forms a second bight through the lower part of the support platform 22.

Thus, referring to FIG. 4, on rotation of the shaft 25 so as to rotate the drive pulley 26*b* clockwise and the drive pulley 26*a* anti-clockwise the upper bight is shortened, the lower bight is lengthened and the support platform 22 is raised; likewise on rotation of the axle 25 so as to move the left hand drive pulley 26*a* clockwise and the right hand drive pulley 26*b* anti-clockwise, the reverse occurs.

Located within the platform 22 (not shown in FIG. 4) is a belt tensioner comprising a block 31 engaging the belt 28 and moveable axially within the platform 22, so as to allow, on assembly, the belt 28 to be tensioned within the piston 22 and then locked in the tensioned position by a locking screw (not shown).

Referring to FIG. 5, the portions of the belt 28 forming the bights are located to travel within a pair of opposed channels 32*a*, 32*b* on the inside of the tubular housing 21 and the axially running outer portions of the belt 28 are located to travel within a pair of channels 33*a*, 33*b* on the outside of the tubular housing 21.

The drive train 24–27 is located within a drive housing 34 at the upper end of the housing 21, the housing 34 including an opening aligned with the tubular housing 21, through which the stack of coins may be raised or lowered.

Referring to FIG. 6, located above the drive housing 34 are a pair of optical emitters 35*a*, 35*b* and a pair of optical receivers 36*a*, 36*b*. The first emitter 35*a* is aligned with the first receiver 36*a* to define a beam path A running diagonally across the center of the opening in the drive housing 34, and the second emitter is likewise aligned with the second receiver 35*b*, 36*b* to define a second beam path B. The beam heights are, in this embodiment, each 0.5 mm, and the second emitter and receiver 35*b*, 36*b* are positioned 0.5 mm above the first so that the second beam B lies just above the first.

Aligned in the plane lying between the two beams A, B is a coin displacing mechanism comprising a bar 37 aligned, in this embodiment, normal to the axis of the tubular housing 21 (i.e. parallel to the planes of the surfaces of coins therein).

Figure 7A:
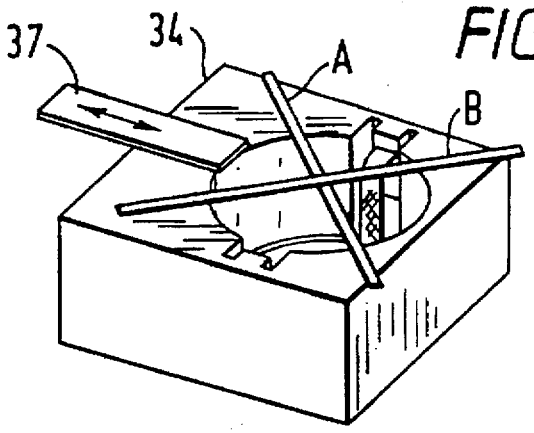
FIG. 7*a* is an isometric view from the same view point as FIG. 3 illustrating the dispensing components shown in FIG. 6.
Figure 7B:
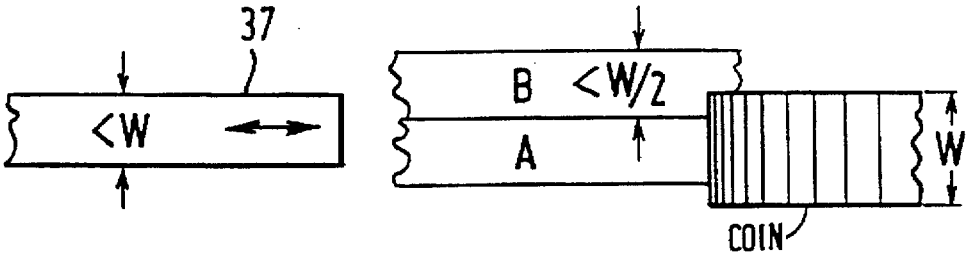
FIG. 7*b* is a detail of FIG. 6 illustrating the position of a coin prior to dispensing.

The bar 37 is in engagement with a linear actuator 38 comprising a rack on the surface of the bar 37 engaging with a toothed wheel 28 driven by a reversible motor 39 (not shown) such that the bar 37 can be withdrawn (leftwards in FIG. 6) to a rest position in which it does not obtrude into the opening in the housing 34, and from which it can be moved by rotation of the motor 39 to traverse the upper surface of the drive housing 34. Thus, when a coin is aligned so as to lie in the plane of the bar 37 and proud of the upper surface of the drive housing 34, the coin can be displaced into the exit channel 70 by actuating the bar 37 to push the coin off the top of the stack, and then withdrawing the bar 37. FIG. 7 shows illustratively the arrangement of the two beams A, B and the bar 37.

Figure 8:
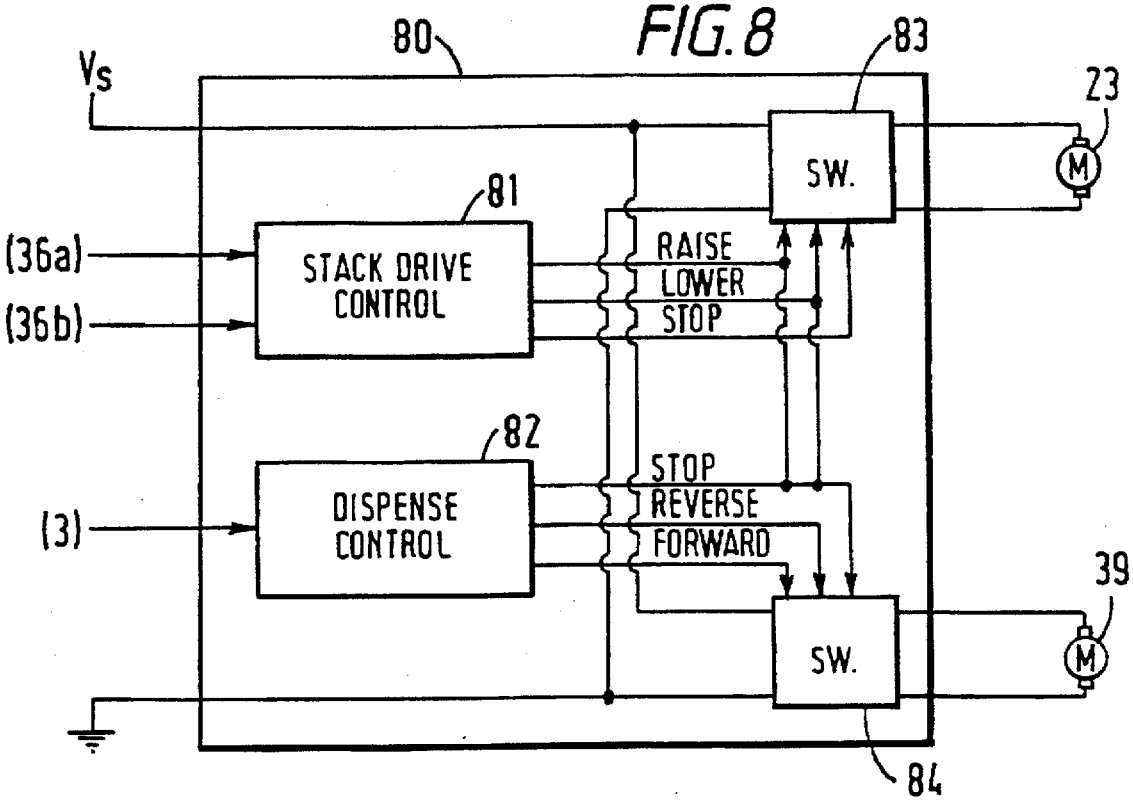
FIG. 8 is a block diagram illustrating a control circuit forming part of FIG. 2.

Referring to FIG. 8, the stack drive system motor 23 and the dispenser motor 39 are energised by the coin stack control circuit 80. The control circuit 80 performs movement of the stack (via the drive motor 23) and dispensing from the stack (via the dispensing motor 39) as separate operations, movement of the stack overriding the operation of dispensing from the stack.

Dispensing

Figure 9:
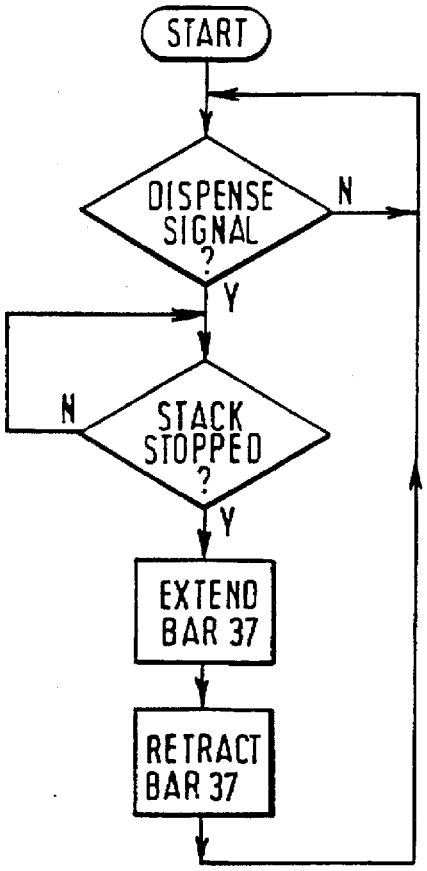
FIG. 9 is a flow diagram showing the operation of the control circuit of FIG. 8 on dispensing a coin.

When a control signal is received from the machine control unit 3, indicating that a coin is to be dispensed, as shown in FIG. 9, if the stack drive motor 23 is not running, the control circuit 80 actuates the dispensing motor 39 so as to rotate (clockwise in FIG. 6) to extend the bar 37 across the stack of coins (so that it engages the uppermost coin in the stack and pushes it off the stack and onto the exit channel 70), then reverses the direction of the motor 39 so as to return the bar 37 to its rest position.

A timing circuit may be provided to control the reversal of the direction of the dispensing motor 39, or alternatively a pair of microswitches or other sensors may be provided, to be actuated by the bar 37 or the wheel 38 at positions where the bar 37 is at its maximum extent of travel and at its rest position.

Stack Control

At all times the control circuit 80 is arranged to maintain the uppermost coin in the stack ready for dispensing at a predetermined dispensing position. Referring to FIGS. 6 and 7, in conjunction with FIG. 10, the control circuit 80 is arranged to respond to the outputs of the two optical sensors 36*a*, 36*b* such that if the outputs of both sensors are low (i.e. if both paths are broken) and therefore a coin has risen above the level of the sensor 36*b*, the motor 23 is energised to lower the stack support platform 22 and hence the uppermost coin. Conversely, if the outputs of both the sensors 36*a*, 36*b* are high (so that the uppermost coin in the stack lies beneath the level of the sensor 36*a*) the motor 23 is energised to raise the stack support platform 22 and hence the uppermost coin. When one of the two paths A, B is broken (i.e. the lower one), the motor 23 is not energised.

Each detector 36*a*, 36*b* may be a commercially available device, and is preferably associated with thresholding circuitry to give a logic level output depending upon whether the received light lies above or below a threshold intensity.

Each optical emitter device 35*a*, 35*b* in this embodiment comprises a light emitting diode, arranged to generate a beam 0.5 mm×2 mm in cross section (for example through an associated curved prism) focused onto the respective optical receiver device.

The vertical separation between the two beams A, B is small, and preferably smaller than the thickness of the smallest type of coin to be received so that the apparatus operates independently of the actual coin denomination present in the coin tube. Thus, when a new coin is inserted on to the top of the stack through the entry channel 60, the top of which should lie between the level of the two sensors 36*a*, 36*b*, the upper beam B received by the upper sensors 36*b* will be broken in addition no the lower beam A, and the control circuit 80 will lower the stack until the upper surface of the newly added coin lies between the level of the two beams A, B. The bar 37 is arranged to engage the uppermost 1 mm of the uppermost coin in the stack, and accordingly the bar 37 is positioned so that it extends 1 mm (which, as mentioned above, corresponds to the thinnest coin received in the coin store) downwardly from the plane between the beams A, B. Thus, since the upper surface of the uppermost coin is accurately located between the sensors 36*a*, 36*b*, the bar 37 will dispense only a single coin at a time. Conveniently, the upper surface of the bar 37 is aligned to move in the plane lying between the sensors 36*a* and 36*b*.

After a coin has been dispensed, the lower beam A as well as the upper beam B is unbroken and accordingly if the control circuit 80 has ceased to de-energise the stack drive motor 23 during the dispensing operation, the stack drive motor 23 raises the coin support platform 22 until the lower beam A is once more broken, indicating than the next coin is ready to be dispensed. In this embodiment, the height of each beam (and the vertical distance between the beams) is no greater than the width of the smallest expected coin, and is preferably no greater than half the width of the coin.

By providing that the two beams A, B cross at the central axis of the tubular housing 21, the detectors are made responsive to coins of different diameters. By providing that the beams A, B are not parallel (and preferably, as shown, divide the opening in the housing 34 into four or more equal radial segments), the sensors 36*a*, 36*b* are made responsive to tilted coins, since no matter what the angle of tilt of position of the coin, it will be raised until it impinges upon one or more of the beams.

Referring to FIG. 8, in greater detail, the control circuit 80 comprises a pair of switch circuits 83, 84, the first switch circuit 83 interconnecting the supply and earth lines with the motor 23 and the second switch circuit 84 interconnecting the supply and earth lines with the motor 39. Each of the switch units is operative to connect the respective motor in one of three states; a de-energised state in which no potential difference is connected across the motor, a forward state in which the supply and earth lines are connected in a first direction across the motor, and a reverse state in which the supply and earth lines are connected in the reverse direction across the motor.

The switch unit 83 which controls the stack drive motor 23 is controlled by a stack drive control circuit 81 connected to the outputs of the optical sensors 36*a*, 36*b* and the switch unit 84 controlling the dispensing motor 39 is controlled by a dispensing control unit 82, operative in response to a dispense command.

Figure 10:
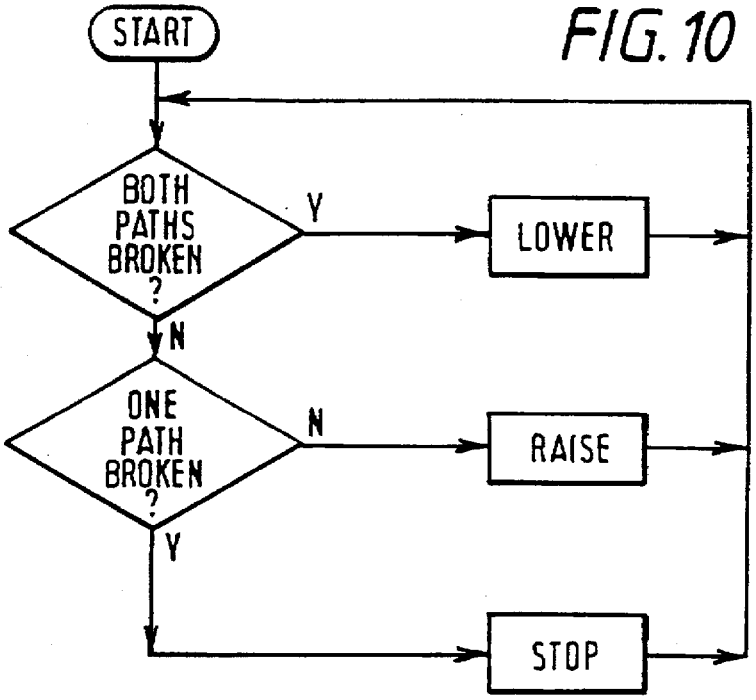
FIG. 10 is a flow diagram showing schematically the operation of the control circuit of FIG. 8 in maintaining the coin stack position.

The control circuit 80 is typically provided by a suitably programmed microprocessor or large scale integrated circuit, executing the process of FIGS. 9 and 10.

Figure 11:
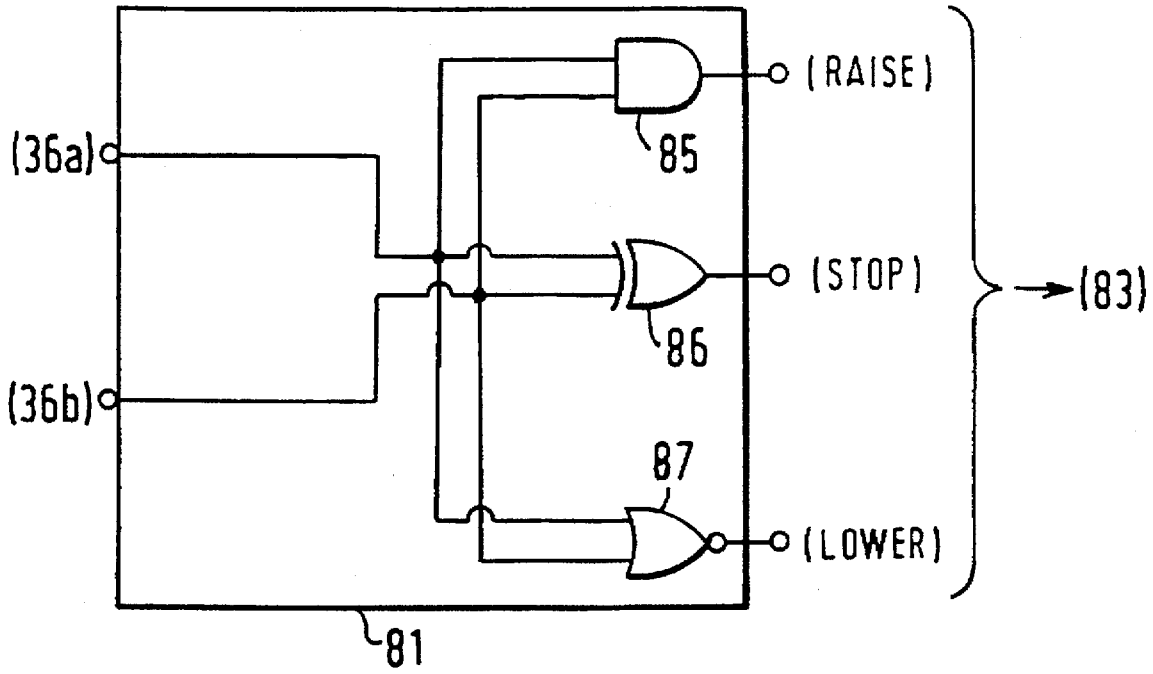
FIG. 11 is a block diagram showing in greater detail a part of the control circuit of FIG. 8 for executing the process of FIG. 10.

Alternatively, the control circuits 81 and 82 could comprise discrete logic circuits operating in accordance with the processes of FIGS. 9 and 10. Referring to FIG. 11, the stack drive control circuit 81 could thus simply comprise three logic gates 83, 84, 85, to combine the detector outputs in AND, NOR and XOR relationship, to respectively raise, lower or stop the motor 23 via the switch unit 83.

The dispenser mechanism comprising the motor 39, wheel 38, and bar 37 are in this embodiment provided, together with the optical emitters 35*a*, 35*b* and receivers 36*a*, 36*b*, in a unit which is mounted within the machine 1 together with the control circuit 80. On the other hand the tubular housing 21, drive motor 23 and drive system housing 34 (including the contents thereof) are provided as a removable unit, which may be inserted into the housing in alignment with the dispensing mechanism, the drive motor 23 being detachably interconnected to the control circuit 80. Thus, a full or empty coin store may be removed by human operator and replaced by another coin store without needing extensive realignment or repositioning since the sensors and the dispensing mechanism are co-located and their positional relationship is unchanged so that whatever tubular housing 21 lies beneath the sensors, the top of the uppermost coin is brought to the same position for dispensing.

In an alternative embodiment, the input drive shaft 24 may be positioned on the uppermost face of the housing 34, and the motor may be positioned directly above it in the apparatus, so that the tube may simply be lifted into engagement with the motor and the sensor system, and retained by some retention means (not shown). This simplifies the changing of tubes. It is also possible for the drive shaft 24 to be solid with the motor 23, and an orifice to be provided in the housing 34 to allow the housing 34 to be assembled to the drive shaft 24.

It may be convenient to provide the coin tube assembly described above with machine readable indicia, from which the identity of the coins within the tubes can be detected. For example, the indicia may be a set of contact pins or contact strips, arranged for contact with pins or pads on the apparatus into which the tube is assembled, and encoding the identity of the contents of the tube in binary or other coded form. Alternatively, optical or other indicia may be used.

Coin Counting

In an embodiment of the invention, a coin count circuit 90 is provided, which keeps count of the number of coins in the coin store by monitoring movements of the coin stack drive system, using a position encoder associated with the drive system. For example, the position encoder may be a rotary encoder on the input shaft 24, axle 25 or one of the pulleys 26*a*, 26*b*, 29*a*, 29*b*; or could be a linear encoder carried on the belt 28. Such encoders are well known and may for example consist of an optical sensor provided solid with the tubular housing 21 or some other fixed component, and a series of spaced features (e.g. light and dark optical bands) at predetermined intervals either radially (on a rotating component) or linearly (along the belt 28). A predetermined number of optical features are spaced so as to pass the optical sensor during a movement of the coin support platform 22 equivalent to the width of one coin. The predetermined number depends upon the thickness of the coin, and preferably the spacing between features is a small fraction of the width of the thinnest coin with which the store may be used, to allow accurate counting.

Figure 12:
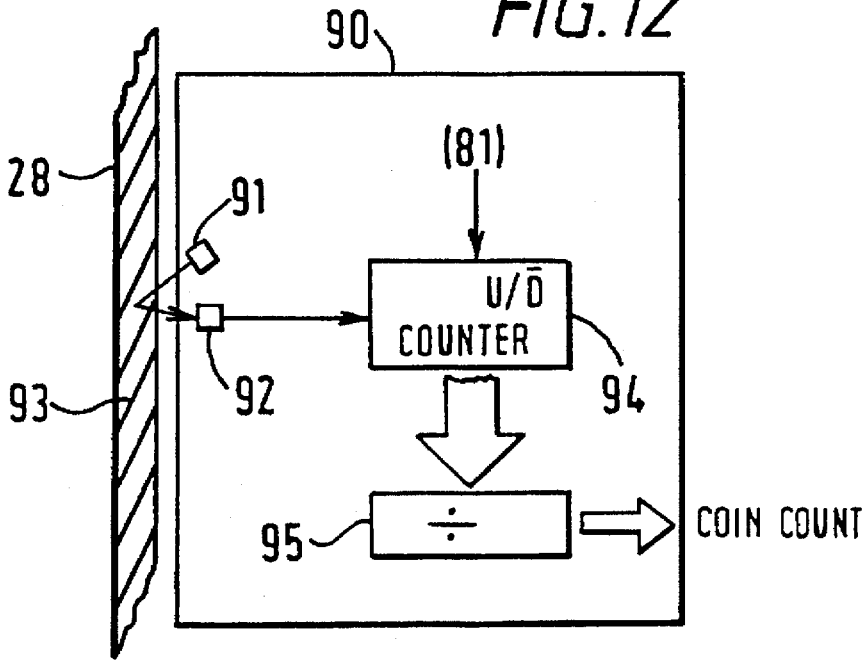
FIG. 12 is a block diagram showing schemanically the operation of a coin counting circuit in an embodiment of the invention.

Referring to FIG. 12, in this embodiment, the coin counter 90 comprises a light source 91 and a light detector 92, the source and detector 91, 92 being arranged so that the detector receives light from the source reflected from an encoder surface 93 comprising a plurality of parallel light bars spaced along the outer surface of the belt 28 at a predetermined spacing. The output of the optical pickup 92 is supplied to a commercially available up/down counter circuit device Coupled to the up/down count control pin of the circuit 94 is a line taken from the output of the stack drive control circuit 81, so that when the coin stack is being raised the counter is controlled to count up and when the coin stack is being lowered the counter 94 is controlled to count down. Thus, the number held in the counter 94 indicates the change in the number of coins since power was first supplied to the counter 94.

To relate the number held in the counter 94 to the number of coins in the stack, a divider circuit 95 is provided which divides the count held in the counter by the predetermined number which comprises the ratio between the spacing between adjacent features and the width of the type of coin held in the store. The coin counter circuit 90 can therefore be adapted for use with a variety of different coin widths by merely changing the predetermined number utilised by the divider circuit 95; typically, several different predetermined numbers each corresponding to a member of a coin set with which the coin store may be used are programmed into the divider circuit 95, and the desired number corresponding to the coin type with which the store is being used is selected by a select signal from the machine control circuit 3.

To obtain an absolute number of coins which is immune to intentional or unintentional losses of power, the control circuit 80 may be arranged, on initial supply of power, to move the coin support platform to 22 to a predetermined position (for example, fully lowered within the tubular housing 21) sensed by, for example, a microswitch or other sensor, prior to supplying power to the counter circuit 94, and to preload the counter circuit 94 with a predetermined number corresponding to the predetermined position, so that subsequent coin counts represent an absolute rather than a relative number of coins.

Other Modifications and Variations

It will be clear from the foregoing that many modifications to the above described embodiments may be made without departing from the spirit of the invention. For example, although the tubular housing has been described as moving vertically, it could in fact be inclined at an angle to the vertical. Likewise, the coin receiving surface of the coin support platform 22 need not be normal to the axis of the tubular housing 21, but could be inclined thereon so as to form a stack of coins having their surfaces inclined to that axis.

Although two beams A, B have been described it will be realised that a greater number of beams could be employed; likewise, a single beam with a quantitative output might be employed although this would be insensitive to tilted coins and more difficult to calibrate.

Although optical indexing has been described, it will be apparent that other sensors (for example, magnetic sensors sensing gear teeth) could be employed.

Although a rack and gear wheel linear actuator for the dispensing mechanism has been described, other linear actuators (for example a rotary cam with a return spring, or a crank) could be employed.

It will be appreciated that, although the present invention has been described with reference to specific embodiments, other arrangements within the spirit and scope of the present invention will be readily apparent to persons of ordinary skill in the art. The present invention is, therefore, limited only by the appended claims.

I claim:

1. A coin store comprising means for forming a stack of coins, a common entry and exit point at one end of the coin stack, means for moving the stack of coins away from and towards that end of the coin stack, a stack positioning system, and means for dispensing a coin from that end, wherein the stack positioning system comprises a drive motor operatively connected to the stack moving means, and the store further comprises position control means for controlling the drive motor to position the stack such that the endmost coin in the stack is placed in a position from which it can be dispensed by the dispensing means, wherein the control means is operable to position the endmost coin ready for dispensing as an operation separate from and prior to the operation of dispensing a coin, and to maintain the stack of coins at a substantially constant level with the endmost coin in a position ready for dispensing, and wherein during a dispensing operation, the dispensing means is actuated prior to any actuation of the stack moving means.

2. A coin store according to claim 1 in which the motor is a reversible electric motor.

3. A coin store according to claim 1 in which the stack moving means comprises an endless belt transmission linking the motor and the stack moving means.

4. A coin store according to claim 1, in which the position control means comprises sensing means for sensing the position of the endmost coin in the stack, and a motor control circuit connected, and responsive to, the sensing means and connected to control the drive motor.

5. A coin store according to claim 4 in which the sensing means comprises first and second coin sensors arranged to sense first and second positions separated along the length of the stack by a separation less than the width of a coin.

6. A coin store according to claim 4 or claim 5 in which the motor control circuit comprises a logic gate circuit.

7. A coin store according to claim 4 which comprises first and second assemblies removably attached to one another, the first assembly comprising the stack forming means and the stack drive system, and the second assembly comprising the dispensing means.

8. A coin store according to claim 7 in which the second assembly also comprises the sensing means.

9. A coin store according to claim 5, in which the first and second sensors comprise optical sensors.

10. A coin store according to claim 1, further comprising means for detecting the length of the coin stack, and means for maintaining a count of the number of coins in the stack based on the detected length.

11. A coin store according to claim 1, in which the dispensing means comprises a linear actuator disposed to move across the coin stack to engage the edge of the endmost coin.

12. A coin store according to claim 1, in which the stack forming means is arranged for use with the entry and exit point uppermost.

13. A coin store according to claim 1, in which the stack moving means is arranged to maintain the position of an endmost coin which is tilted, relative to the planes of the surfaces of other coins in the stack, such that the portion of the endmost coin which is outermost of the coin stack is aligned with the dispensing means.

14. A coin stack positioning system, which comprises first and second sensors for sensing first and second positions separated along the length of the coin stack by a separation less than the width of a coin, and stack moving means arranged to be responsive to the sensor outputs, to position a coin to lie with an outer portion between the first and second sensors.

15. A coin store comprising a coin stack positioning system as defined in claim 14, and further comprising means for forming a stack of coins, and dispensing means for dispensing a coin from the stack.

16. A coin store according to claim 15, in which the first and second sensors comprise optical sensors.

17. A coin store according to claim 16 in which there are provided first and second light sources located so as to define first and second beam paths between respectively, the first light source and first sensor, and the second light source and second sensor.

18. A coin store according to claim 17 in which the first and second beam paths lie approximately in planes parallel to those of the coin surfaces in the stack.

19. A coin store according to claim 17 in which the first and second beam paths are not parallel, the second beam path being angularly offset about the coin stack axis relative to the first beam path.

20. A coin store according to claim 15, further comprising means for detecting the length of the coin stack, and means for maintaining a count of the number of coins in the stack based on the detected length.

21. A coin store according to claim 20 in which the means for detecting the length of the stack is responsive to the stack moving means.

22. A coin store according to claim 21 in which the means for detecting the length of the stack comprises sensing means for detecting the passage of a plurality of spaced features provided on the stack moving means.

23. A coin store according to claim 22 in which the stack moving means comprise an endless belt upon which the features are provided.

24. A coin store according to claim 22 in which the sensing means comprises an optical detector responsive to optical features on the stack moving means, said detector and said features comprising an optical encoder.

25. A coin store according to claim 15, in which the dispensing means comprises a linear actuator disposed to move across the coin stack to engage the edge of the endmost coin.

26. A coin store according to claim 15, in which the stack forming means is arranged for use with the entry and exit point uppermost.

27. A coin store according to claim 15, in which the stack moving means is arranged to maintain the position of an endmost coin which is tilted, relative to the planes of the surfaces of other coins in the stack, such that the portion of the endmost coin which is outermost of the coin stack is aligned with the dispensing means.

28. A coin store comprising a coin carrying tube with a common coin entry and exit point arranged at one end, a coin dispenser and a coin stack positioning system comprising a coin stack displacement motor, the coin store further comprising a coin stack length detector and a counter maintaining a count of the number of coins in the stack based on the detected length, wherein the stack positioning system is arranged to move the coin stack to a predetermined position upon being activated, prior to the activation of the coin counter.

29. A coin store according to claim 28, wherein the predetermined position is the end of the coin carrying tube remote from the common coin entry and exit point.

30. A coin store according to claim 28, wherein the predetermined position is the position in which the coin stack is fully lowered.

31. A method of operating a coin store which comprises a coin carrying tube with a common coin entry and exit point arranged at one end, a coin dispenser and a coin stack positioning system comprising a coin stack displacement motor, the coin store further comprising a coin stack length detector and a counter maintaining a count of the number of coins in the stack based on the detected length, the method comprising:

activating the coin stack positioning system upon activating the coin store;

moving the coin stack to a predetermined position under the control of the coin stack positioning system, prior to activating the coin counter; and activating the coin counter.

32. A method of operating a coin store according to claim 31, wherein the predetermined position is the end of the coin carrying tube remote from the common coin entry and exit point.

33. A method of operating a coin store, according to claim 31, wherein the predetermined position is the position in which the coin stack is fully lowered.

* * * * *

UNITED STATES PATENT AND TRADEMARK OFFICE

CERTIFICATE OF CORRECTION

PATENT NO. : 5,718,625

DATED : February 17, 1998

INVENTOR(S) : Richard Guy Bointon

It is certified that error appears in the above-identified patent and that said Letters Patent is hereby corrected as shown below:

Col. 1, line 7, cancel "snore" and insert --store--.

Col. 1, line 29, cancel "i:" and insert --it--.

Col. 1, line 55, cancel "slack" and insert --stack--.

Col. 4, line 63, cancel "slack" and insert --stack--.

Col. 5, line 20, cancel "The" and insert --the--.

Col. 7, line 6, cancel "no" and insert --to--.

Signed and Sealed this

Twenty-first Day of March, 2000

*Attest:*

*Attesting Officer*

Q. TODD DICKINSON

*Commissioner of Patents and Trademarks*